US008365334B2

(12) United States Patent
Bae et al.

(10) Patent No.: US 8,365,334 B2
(45) Date of Patent: Feb. 5, 2013

(54) WASHING MACHINE AND METHOD OF CONTROLLING A WASHING MACHINE

(75) Inventors: Sun Cheol Bae, Changwon-si (KR); Kyung Hoon Kim, Changwon-si (KR); Han Su Jung, Changwon-si (KR); Jae Hyeok Choi, Changwon-si (KR); Ja In Koo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 624 days.

(21) Appl. No.: 12/470,800

(22) Filed: May 22, 2009

(65) Prior Publication Data

US 2009/0300851 A1 Dec. 10, 2009

(30) Foreign Application Priority Data

May 23, 2008 (KR) ..... 10-2008-0048184

(51) Int. Cl.
*D06F 33/00* (2006.01)

(52) U.S. Cl. ..... 8/159; 68/12.02; 68/12.06

(58) Field of Classification Search ..... 8/158, 159; 68/12.06, 12.02
See application file for complete search history.

(56) References Cited

U.S. PATENT DOCUMENTS

| | | | | |
|---|---|---|---|---|
| 3,301,024 A | | 1/1967 | Smith | 68/12 |
| 4,782,544 A | | 11/1988 | Nystuen et al. | 8/159 |
| 5,207,764 A | * | 5/1993 | Akabane et al. | 68/20 |
| 5,671,494 A | * | 9/1997 | Civanelli et al. | 8/159 |
| 5,692,313 A | | 12/1997 | Ikeda et al. | 34/58 |
| 5,768,730 A | * | 6/1998 | Matsumoto et al. | 8/159 |
| 5,887,456 A | * | 3/1999 | Tanigawa et al. | 68/20 |
| 6,029,299 A | | 2/2000 | Baek et al. | 8/159 |
| 6,240,586 B1 | | 6/2001 | Joo | 8/159 |
| 6,381,791 B1 | | 5/2002 | French et al. | 8/159 |
| 6,578,225 B2 | * | 6/2003 | Jonsson | 8/159 |
| 7,412,740 B2 | | 8/2008 | Park et al. | 8/159 |
| 7,478,547 B2 | | 1/2009 | Okazaki et al. | 68/12.04 |
| 7,490,490 B2 | * | 2/2009 | Hirasawa et al. | 68/12.04 |
| 7,530,133 B2 | * | 5/2009 | Mitts | 8/159 |

(Continued)

FOREIGN PATENT DOCUMENTS

| | | |
|---|---|---|
| CA | 2 360 476 C | 5/2002 |
| CN | 1966812 A | 5/2007 |

(Continued)

OTHER PUBLICATIONS

European Patent Office 0 087 706 Nov. 1997.*

(Continued)

*Primary Examiner* — Frankie L Stinson
(74) *Attorney, Agent, or Firm* — KED & Associates LLP

(57) ABSTRACT

A washing machine and a method of controlling the washing machine are provided. According to the washing machine and method of controlling the washing machine, the drum is operated at a first speed so that part of laundry within the drum tumbles and another part of the laundry adheres to the drum. When an unbalance amount of the drum operating at the first speed is a first specific value or less, the speed of the drum is increased to a second speed so that all of the laundry adheres to the drum. When an unbalance amount of the drum detected during the increasing to the second speed is a second specific value or more, the rotation of the drum is decelerated. Accordingly, at a time of a dehydration cycle, stability of the washing machine and laundry balancing can be ensured.

16 Claims, 7 Drawing Sheets

U.S. PATENT DOCUMENTS

| | | | | |
|---|---|---|---|---|
| 7,627,920 | B2 | 12/2009 | Wong et al. | 8/159 |
| 2002/0020196 | A1 * | 2/2002 | Kakuda et al. | 68/12.06 |
| 2003/0140427 | A1 | 7/2003 | Yamamoto et al. | 8/159 |
| 2005/0102766 | A1 | 5/2005 | Vande Haar et al. | 8/159 |
| 2005/0251926 | A1 | 11/2005 | Lee et al. | |
| 2005/0268670 | A1 | 12/2005 | Hirasawa et al. | 68/12.06 |
| 2006/0005319 | A1 * | 1/2006 | Park | 8/158 |
| 2006/0107299 | A1 | 5/2006 | Bartfeld et al. | 75/110 |
| 2006/0185095 | A1 | 8/2006 | Mitts | 8/158 |
| 2006/0207299 | A1 | 9/2006 | Okazaki et al. | 68/12.02 |
| 2008/0289118 | A1 | 11/2008 | Park et al. | 8/159 |
| 2009/0307851 | A1 | 12/2009 | Bae et al. | 8/159 |

FOREIGN PATENT DOCUMENTS

| | | | | |
|---|---|---|---|---|
| DE | 36 06 819 | A1 | | 9/1987 |
| DE | 38 40 265 | A1 | | 5/1990 |
| DE | 41 22 307 | A1 | | 1/1993 |
| DE | 42 29 646 | A1 | | 3/1994 |
| DE | 44 38 760 | A1 | | 5/1996 |
| DE | 102 34 373 | A1 | | 2/2004 |
| DE | 10 2006 017 530 | A1 | | 10/2007 |
| EP | 1 516 952 | A2 | | 3/2005 |
| EP | I 538 251 | A2 | | 6/2005 |
| EP | 1 760 181 | A1 | | 3/2007 |
| GB | 2 073 257 | | * | 10/1981 |
| GB | 2 327 502 | A | | 1/1999 |
| JP | 64-040093 | | * | 2/1989 |
| JP | 01-268597 | | * | 10/1989 |
| JP | 02-109593 | | * | 4/1990 |
| JP | 02-136173 | A | | 5/1990 |
| JP | 04-176494 | | * | 6/1992 |
| JP | 04-176494 | A | | 6/1992 |
| JP | 06-218181 | A | | 8/1994 |
| JP | 08-299660 | A | | 11/1996 |
| JP | 10-005485 | | * | 1/1998 |
| JP | 10-127978 | A | | 5/1998 |
| JP | 10-216391 | | * | 8/1998 |
| JP | 11-216296 | | * | 8/1999 |
| JP | 2000-157788 | A | | 6/2000 |
| JP | 2001-224889 | | * | 8/2001 |
| JP | 2005-199090 | A | | 7/2005 |
| JP | 2008-054960 | | * | 3/2008 |
| KR | 10-1994-0015033 | A | | 7/1994 |
| KR | 10-2000-0033342 | A | | 6/2000 |
| KR | 10-2001-0004704 | A | | 1/2001 |
| KR | 10-2004-0046049 | A | | 6/2004 |
| KR | 10-2005-0012524 | A | | 2/2005 |
| KR | 10-2005-0042945 | A | | 5/2005 |
| KR | 10-2006-0049526 | A | | 5/2006 |
| WO | WO 00/28128 | A1 | | 5/2000 |
| WO | WO 2004/009899 | A1 | | 1/2004 |
| WO | WO 2005/106096 | A1 | | 11/2005 |

OTHER PUBLICATIONS

Canadian Office Action dated May 30, 2011 issued in Application No. 2,666,777.
Canadian Office Action dated May 30, 2011 issued in Application No. 2,666,779.
U.S. Office Action dated Jul. 19, 2011 issued in U.S. Appl. No. 12/466,495.
Chinese Office Action dated Aug. 19, 2010 issued in Application No. 200910141732.1.
Korean Office Action dated Mar. 29, 2010 issued in Application No. 10-2008-0048182.
Korean Office Action dated Mar. 16, 2010 issued in Application No. 10-2008-0048186.
European Search Report dated Sep. 11, 2009 issued in Application No. 09 16 0861.
European Search Report dated Aug. 6, 2009 issued in Application No. 09 16 0863.
Korean Office Action dated Mar. 29, 2010 for Application No. 10-2008-0048184.
Korean Office Action dated Mar. 30, 2010 for Application No. 10-2008-0048183.
Korean Office Action dated Mar. 16, 2010 for Application No. 10-2008-0048185.
Korean Office Action dated Mar. 16, 2010 for Application No. 10-2008-0048277.
Chinese Office Action dated Oct. 20, 2010 issued in Application No. 200910141728.6.
German Office Action dated Jul. 5, 2011 issued in Application No. 10 2009 021 942.0.
German Office Action dated Jul. 5, 2011 issued in Application No. 10 2009 021 947.1.
German Office Action dated Jul. 8, 2011 issued in Application No. 10 2009 021 941.2.
German Office Action dated Jul. 8, 2011 issued in Application No. 10 2009 021 949.8.
United States Office Action dated Aug. 23, 2011 issued in U.S. Appl. No. 12/470,804.
United States Office Action dated Aug. 23, 2011 issued in U.S. Appl. No. 12/470,818.
United States Office Action dated Aug. 24, 2011 issued in U.S. Appl. No. 12/470,815.
U.S. Office Action dated Oct. 31, 2011 issued in U.S. Appl. No. 12/466,513.
U.S. Office Action dated Jul. 25, 2012 in U.S. Appl. No. 12/466,495.
U.S. Office Action dated Jan. 10, 2012 in U.S. Appl. No. 12/466,495.
U.S. Office Action dated Mar. 12, 2012 in U.S. Appl. No. 12/470,815.
Notice of Allowance dated Mar. 16, 2012 in U.S. Appl. No. 12/470,818.
U.S. Office Action dated Apr. 5, 2012 in U.S. Appl. No. 12/466,513.

* cited by examiner

WASHING MACHINE AND METHOD OF CONTROLLING A WASHING MACHINE

This application claims priority from Korean Patent Application No. 10-2008-0048184, filed May 23, 2008, the subject of which is incorporated herein by reference.

BACKGROUND

1. Field

Embodiments of the present invention may relate to a washing machine and a method of controlling the washing machine. More particularly, embodiments of the present invention may relate to a washing machine and a method therefore having improved stability and improved laundry balancing at a time of a dehydration cycle.

2. Background

A drum-type washing machine may perform washing by employing a drum that rotates by a driving force of a motor and frictional force of laundry in a state in which a detergent, wash water, and the laundry are input to the drum. The drum-type washing machine may rarely damage the laundry, may rarely entangle the laundry, and may have knocking and rubbing washing effects.

After wash and rinse cycles are finished, a dehydration cycle is performed. In order to perform the dehydration cycle, laundry must be distributed effectively. To this end, a variety of methods have been used. For example, a method of determining an unbalance amount in the state in which laundry is adhered to the drum was used. However, this method is disadvantageous in that it has a long balancing time of laundry and the state of laundry is decided by sensing an unbalance amount of the laundry in the state in which the laundry is adhered to the drum. Further, in the case in which laundry is unbalanced with the laundry being adhered to the drum, it becomes problematic in the stability of a washing machine.

BRIEF DESCRIPTION OF THE DRAWINGS

Objects and features of arrangements and embodiments of the present invention may become apparent from the following description taken in conjunction with the accompanying drawings, in which like reference numerals refer to like elements and wherein.

DETAILED DESCRIPTION

Arrangements and embodiments of the present invention may be described in detail with reference to the accompanying drawings.

Figure 1:
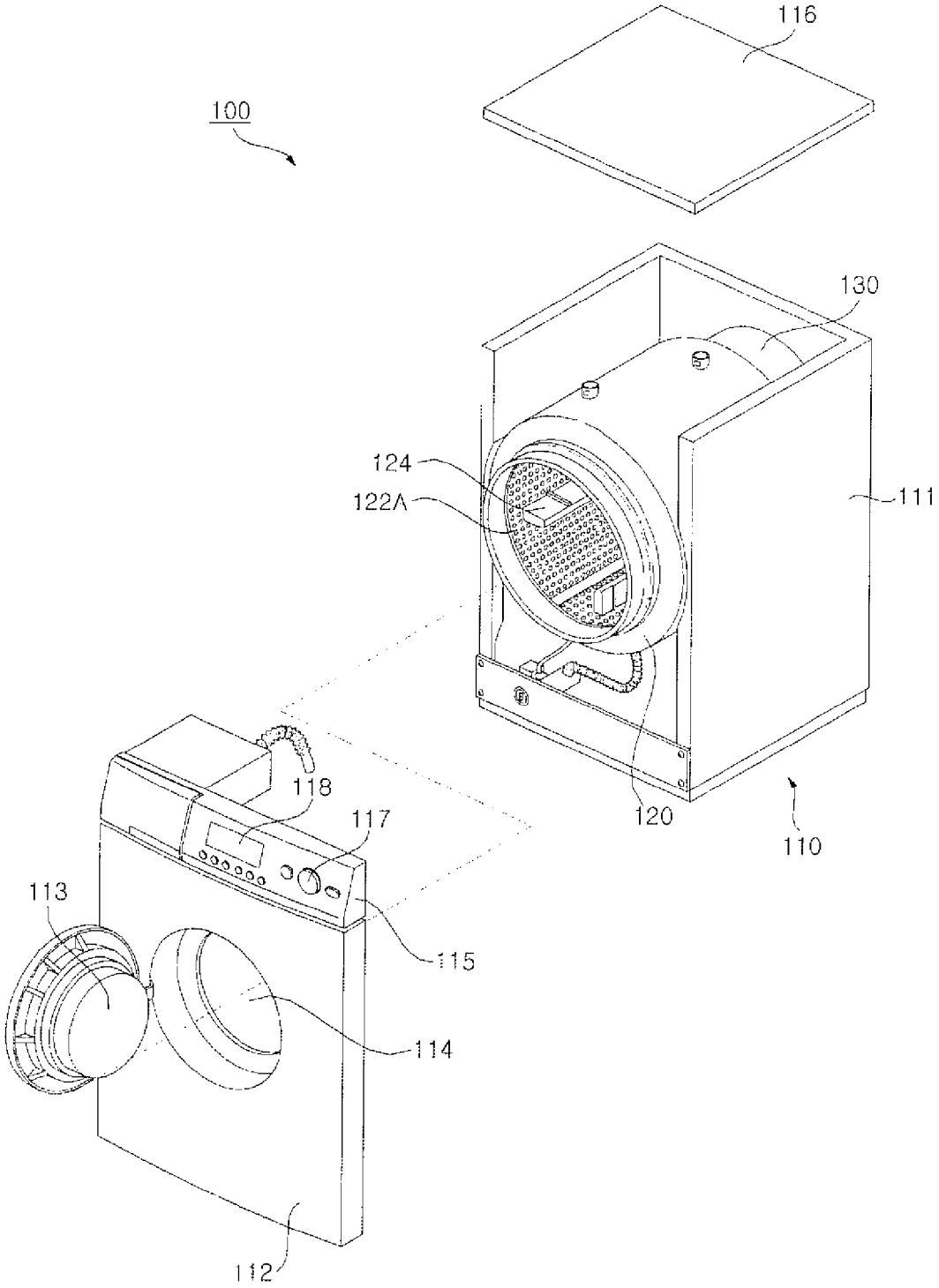
FIG. 1 is a perspective view showing a washing machine in accordance with an embodiment of the present invention.

FIG. 1 is a perspective view showing a washing machine in accordance with an embodiment of the present invention.

Description is given below with reference to the drawing. A washing machine 100 includes a cabinet 110 forming an external shape of the washing machine 100, a tub 120 disposed within the cabinet 110 and supported by the cabinet 110, a drum 122 disposed within the tub 120 in which laundry is washed, a motor 130 for driving the drum 122, a wash water supply apparatus (not shown) disposed outside a cabinet main body 111 and configured to supply wash water to the cabinet 110, and a drain apparatus (not shown) formed under the tub 120 and configured to drain wash water to the outside.

A plurality of through-holes 122A for having wash water pass therethrough is formed in the drum 122. Lifters 124 can be disposed within the drum 112 so that the laundry is raised up to a specific height when the drum 122 is rotated and then dropped because of gravity.

The cabinet 110 includes the cabinet main body 111, a cabinet cover 112 disposed on the front side of the cabinet main body 111 and coupled thereto, a control panel 115 disposed on an upper side of the cabinet cover 112 and coupled to the cabinet main body 111, and a top plate 116 disposed at the top of the control panel 115 and coupled to the cabinet main body 111.

The cabinet cover 112 includes a laundry inlet/outlet hole 114 formed to have laundry pass therethrough, and a door 113 disposed rotatably left and right so that the laundry inlet/outlet hole 114 is opened and closed.

The control panel 115 includes a control button 117 for manipulating operating states of the washing machine 100, and a display device 118 disposed on one side of the control button 117 and configured to display operating states of the washing machine 100.

The control button 117 and the display device 118 within the control panel 115 are electrically connected to a controller (not shown). The controller (not shown) electrically controls respective constituent elements, etc. of the washing machine 100. An operation of the controller (not shown) is described later on.

Figure 2:
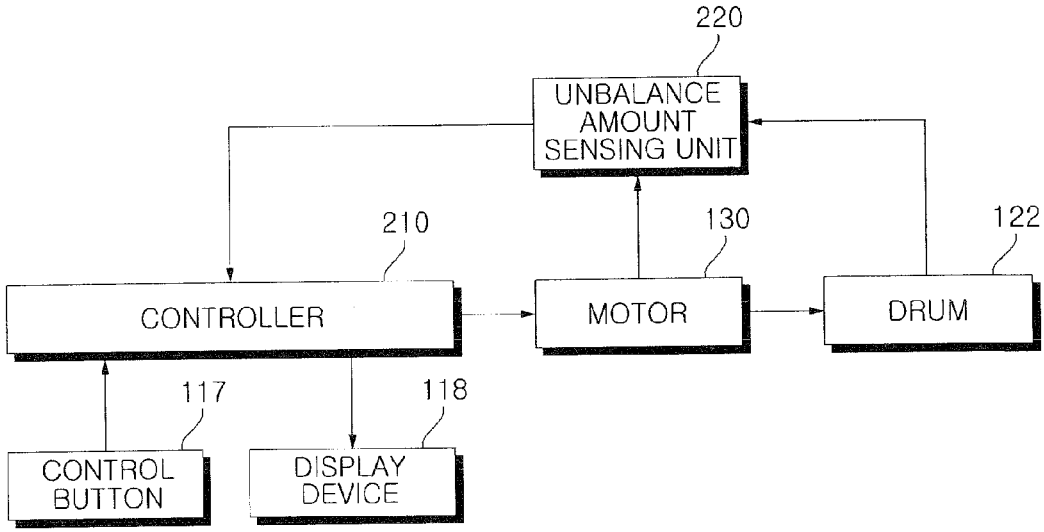
FIG. 2 is an internal block diagram of the washing machine shown in FIG. 1.

FIG. 2 is an internal block diagram of the washing machine shown in FIG. 1.

Description is given below with reference to the drawing. First, a controller 210 operates in response to an operation signal received from the control button 117. Thus, actual washing, rinse, and dehydration cycles can be performed. For the actual washing, rinse, and dehydration cycles, the controller 210 controls the motor 130. Although not shown in the drawings, an inverter (not shown) can be used to control the motor. For example, when the controller 210 outputs a PWM switching control signal to the inverter (not shown), the inverter (not shown) can perform a high-speed switching operation in order to supply an AC power of a specific frequency to the motor 130.

Meanwhile, the controller 210 can display operating states of the washing machine 100 through the display device 118. For example, the controller 210 can display operating states, such as actual washing, rinse, and dehydration cycles, through the display device 118.

The motor 130 drives the drum 122. The drum 122 is disposed within the tub 120, as shown in FIG. 1, and has laundry for washing input therein. The drum 122 is driven by the rotation of the motor 130.

An unbalance amount sensing unit 220 senses an unbalance amount of the drum 122, that is, unbalance (UB) of the drum 122. The unbalance amount can be sensed based on a rotation speed variation of the drum 122, that is, a rotation speed variation of the motor 130. To this end, a speed sensor (not shown) for sensing a rotation speed of the motor 130 can be further included. Meanwhile, a rotation speed of the motor 130 can be calculated based on an output current value flowing through the motor 130, and an unbalance amount can be sensed based on the rotation speed. To this end, the motor 130 can include a current sensor (not shown), for example, an encoder.

Meanwhile, although it is shown that the unbalance amount sensing unit 220 is provided separately from the controller 210, the present invention is not limited to the above example. Alternatively, the unbalance amount sensing unit 220 may be included within the controller 210. In this case, a rotation speed and an output current value of the motor 130, which are respectively sensed by the speed sensor (not shown) and the current sensor (not shown), can be input to the controller 210.

Meanwhile, although not shown in the drawings, a laundry amount sensor (not shown) may be further included. The laundry amount sensor (not shown) can input the load of sensed laundry to the controller 210.

Figure 3:
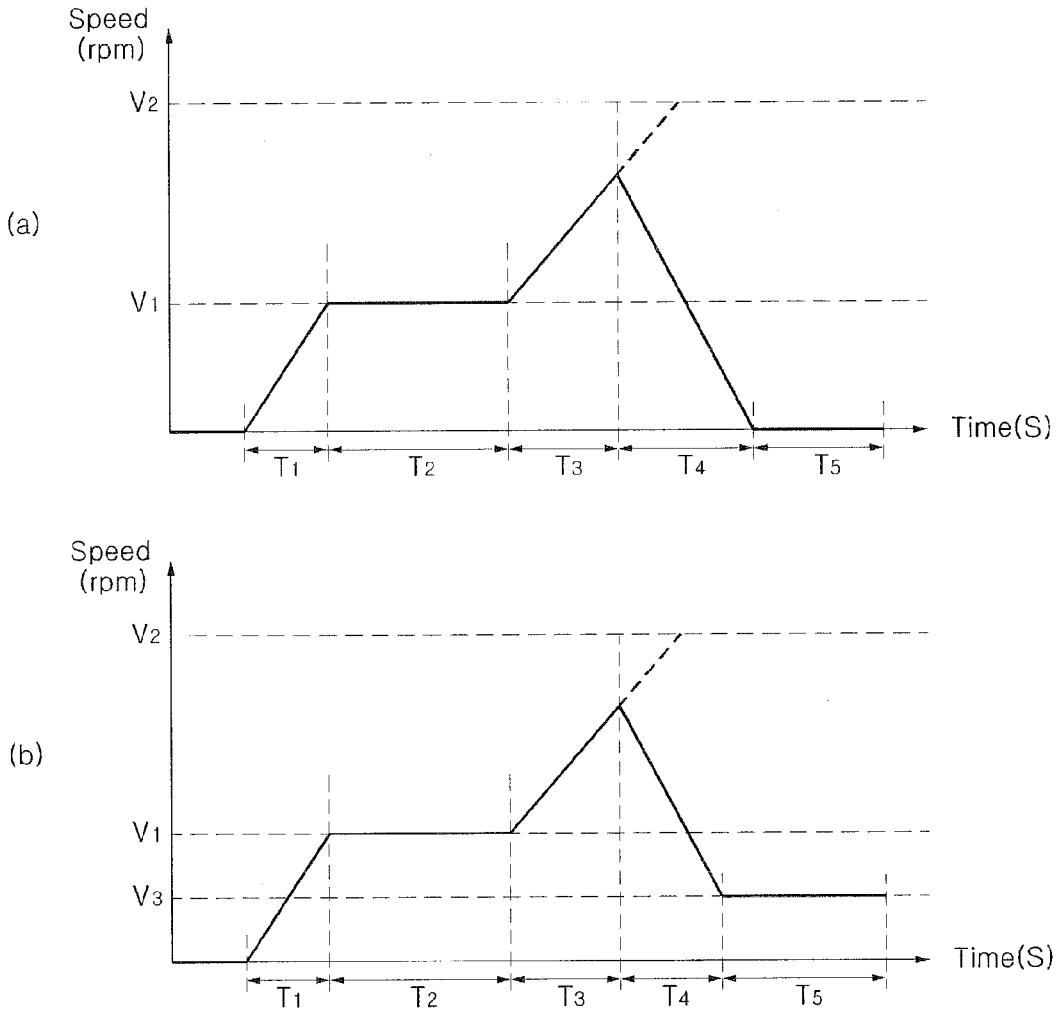
FIG. 3 is a graph showing an example of the relationship between the rotation speed of a drum within the washing machine shown in FIG. 1 and time.
Figure 4:
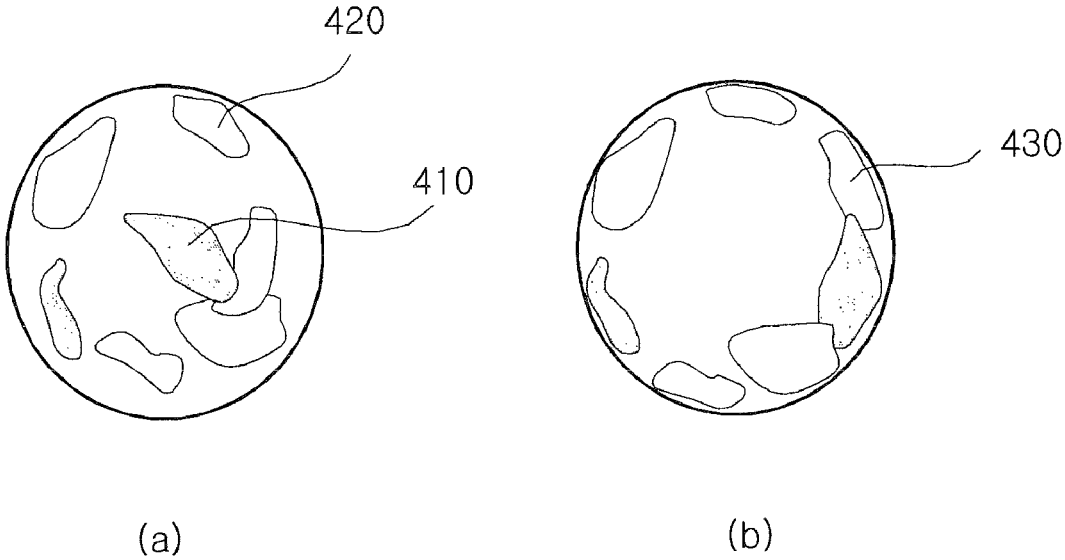
FIG. 4 is a diagram showing the states of laundry within the drum according to a first speed and a second speed.

FIG. 3 is a graph showing an example of the relationship between a rotation speed and time of the drum within the washing machine of FIG. 1. FIG. 4 is a diagram showing the states of laundry within the drum according to a first speed and a second speed.

Description is given below with reference to the drawings. In relation to the dehydration cycle of the washing machine in accordance with an embodiment of the present invention, first, a rotation speed of the drum 122 is raised to a first speed V1 during a first period T1. Here, the first speed V1 is, as shown in FIG. 4(*a*), a speed at which a part 410 of laundry is tumbled within the drum and the other part 420 of the laundry is adhered within the drum. For example, the first speed V1 may be a speed at which 20 to 30% of a total of laundry is tumbled within the drum and 70 to 80% of the total of the laundry is adhered within the drum.

During a second period T2, the drum 122 is operated at the first speed V1. When an unbalance amount sensed by the unbalance amount sensing unit 220 during the first speed operation is a first specific value or less (that is, the rotation of the drum has been stabilized), the rotation speed of the drum 122 is raised to a V2. Here, the second speed V2 is a speed at which the entire laundry 430 are adhered within the drum, as shown in FIG. 4(*b*).

During a third period T3, the rotation speed of the drum 122 is raised toward the second speed V2 with a specific slope. When a sensed unbalance amount of the drum 122 is a second specific value or more while the speed of the drum 122 rises to the second speed V2 (that is, when abnormality occurs), the rotation of the drum 122 is stopped or decelerated.

FIG. 3(*a*) shows a case where the drum 122 is stopped, and FIG. 3(*b*) shows a case where the drum 122 is decelerated and then operated at a third speed V3. In the case in which the rotation of the drum 122 is stopped as shown in FIG. 3(*a*), the drum 122 is decelerated during a fourth period T4. Subsequently, during a fifth period T5, the rotation of the drum 122 is stopped. Meanwhile, in the case in which the rotation speed of the drum is decelerated to the third speed V3 as shown in FIG. 3(*b*), the rotation speed of the drum 122 is decelerated during the fourth period T4. Subsequently, during a fifth period T5, the drum is operated at the third speed V3.

As described above, when the rotation speed of the drum 122 rises to the second speed V2 after the first speed (V1) operation, an unbalance amount of the drum is determined, and, when abnormality occurs, the rotation of the drum 122 is stopped or decelerated. Accordingly, stability of the washing machine 100 and laundry balancing at the time of a dehydration cycle can be ensured. Meanwhile, the drum 122 can be driven at the first speed V1 at which a part of the laundry is tumbled so as to meet the balancing state of the laundry to some extent, not at a speed at which the entire laundry are tumbled as in the prior art, and the drum can be then operated at the second speed V2. Accordingly, laundry can be distributed accurately and rapidly.

Meanwhile, the first speed V1 can be about 60 rpm, the second speed V2 can be about 108 rpm, and the third speed V3 can be about 30 rpm.

Figure 5:
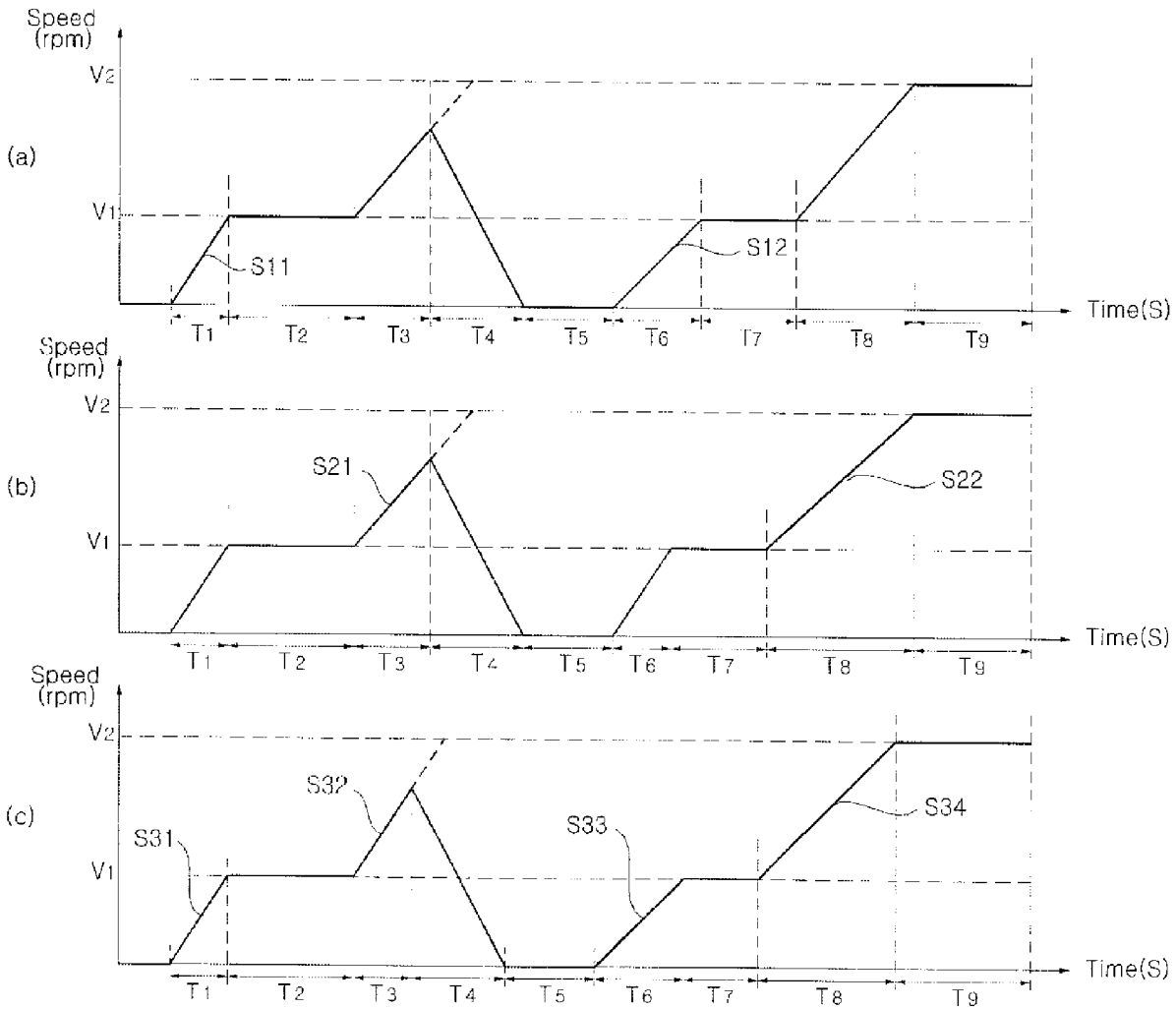
FIG. 5 is a graph showing an example of the relationship between the rotation speed of the drum within the washing machine shown in FIG. 1 and time.

FIG. 5 is a graph showing an example of the relationship between the rotation speed of the drum within the washing machine shown in FIG. 1 and time.

Description is given below with reference to the drawings. FIGS. 5(*a*) to 5(*c*) are almost similar to those of FIG. 3(*a*). In other words, a rise to a first speed T1 during a first time T1, an operation at the first speed V1 during a second time T2, a rise to a second speed V2 during a third period T3, a drop to a stop speed during a fourth period T4, and a stop during a fifth period T5 in FIG. 5 are identical to those of FIG. 3(*a*).

When the drum 122 is operated again after being stopped, a rotation speed of the drum rises to the first speed V1 during a sixth period T6, and then operated at the first speed V1 during a seventh period T7. When an unbalance amount sensed by the unbalance amount sensing unit 220 during the first speed (V1) operation is a first specific value or less (that is, the speed of the drum has been stabilized), the speed of the drum 122 is raised to the second speed V2. Here, the second speed V2 is a speed at which the entire laundry 430 are adhered within the drum 122, as shown in FIG. 4(*b*).

During an eighth period T8, the rotation speed of the drum rises toward the second speed V2 with a specific slope. When an unbalance amount of the drum 122, which is sensed when the speed of the drum rises toward the second speed V2, is not a second specific value or higher (that is, the rotation speed of the drum has been stabilized), the drum is operated at the second speed V2 during a ninth period T9.

Meanwhile, when the drum is operated again after the sixth period T6, at least one of the first speed (V1) rising slope and the second speed (V2) rising slope can be changed. This is for the purpose of improving stability of the washing machine 100 and the balancing state of laundry by taking that, when the speed of the drum rises to the second speed V2, a sensed unbalance amount is a second specific value or more (that is, abnormally) into consideration.

The first speed (V1) rising slope and the second speed (T2) rising slope can be changed within a specific range. For example, when the drum is operated again, the first speed (V1) rising slope and the second speed (V2) rising slope can be made gentle so as to improve stability of the washing machine and balancing of laundry. However, the present invention is not limited thereto, but each rising slope may be changed abruptly within a specific range.

Meanwhile, when the drum is operated again after the sixth period T6, the drum 122 can be driven in a reverse direction. In other words, in the case in which the drum 122 is operated in a first direction during the first to fourth periods T1 to T4, the drum 122 can be operated in a second direction, which is opposite to the first direction, when the drum is operated again after the sixth period T6.

FIG. 5(*a*) shows a case where first speed rising slopes S11 and S12 are changed before and after the drum is operated again. FIG. 5(*b*) shows a case where second speed rising slopes S21 and S22 are changed before and after the drum is operated again. FIG. 5(*c*) shows a case where first speed rising slopes S31 and S33 and second speed rising slopes S32 and S34 are changed before and after the drum is operated again.

Meanwhile, although not shown in the drawings, after the second speed (V2) operation in which the entire laundry are adhered within the drum 122, at least once water drain process that is operated at a resonant speed or less may be performed so as to remove moisture included in laundry. After the water drain process is completed, a full-scale dehydration process operated at a maximum speed of the drum can be performed.

Meanwhile, the relationships between the rotation speed of the drum within the washing machine and time, as shown in FIGS. 3 and 5, were established according to operating states of the controller 210. The controller 210 can control an operation speed, an operating time, and so on of the drum 122 in consideration of an unbalance amount of the drum 122, operation commands, a laundry amount, the type of laundry, and so on.

Figure 6:
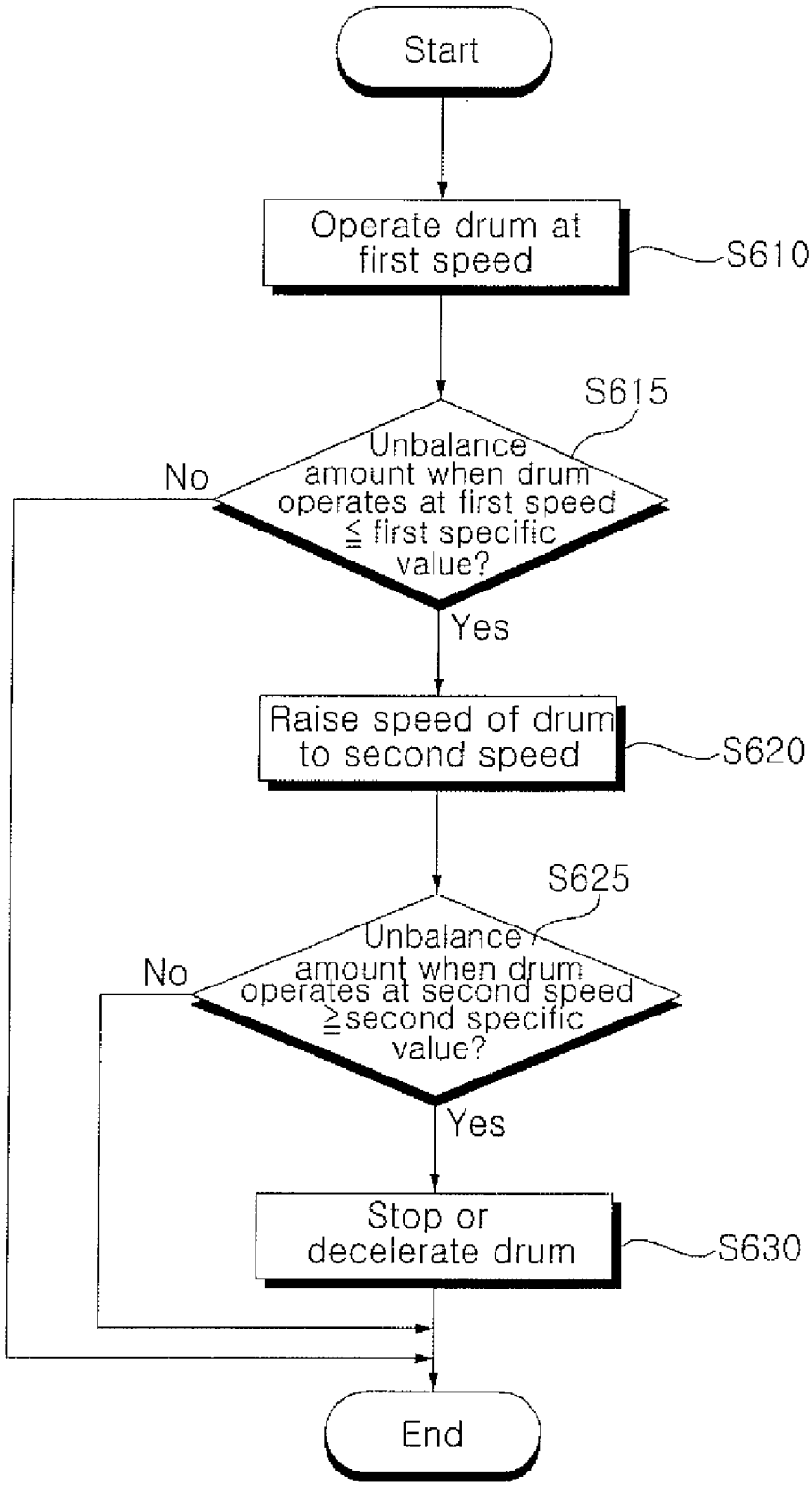
FIG. 6 is a flowchart illustrating a method of controlling the washing machine in accordance with an embodiment of the present invention.

FIG. 6 is a flowchart illustrating a method of controlling the washing machine in accordance with an embodiment of the present invention.

Description is given below with reference to the drawings. The controller 210 controls the drum 122 to operate at the first speed V1 in step S610. As shown in FIG. 3(*a*), a rotation speed of the drum 122, being in a stop state, is raised to the first speed V1 and then operated at the first speed V1. The first speed V1 is a speed at which a part of laundry is tumbled within the drum 122 and the other part of the laundry is adhered within the drum 122. For example, the first speed V1 may be a speed at which 20 to 30% of a total of laundry is tumbled within the drum and 70 to 80% of the total of the laundry is adhered within the drum.

The controller 210 then determines whether an unbalance amount during the first speed (V1) operation is a first specific value or less in step S615. That is, the controller 210 determines whether an unbalance amount sensed by the unbalance amount sensing unit 220 is a first specific value or less.

If, as a result of the determination, the unbalance amount during the first speed (V1) operation is the first specific value or less, the controller 210 raises the rotation speed of the drum to the second speed V2 in step S620. Here, the second speed V2 is, as shown in FIG. 4(*b*), a speed at which the entire laundry 430 are adhered within the drum 122.

Next, the controller 210 determines whether an unbalance amount, which is sensed when the rotation speed of the drum 122 rises to the second speed V2, is a second specific value or higher in step S625.

If, as a result of the determination, the unbalance amount, which is sensed when the rotation speed of the drum 122 rises to the second speed V2, is the second specific value or higher, the controller 210 stops or decelerates the drum 122 in step S630. FIG. 3(*a*) shows a case where the drum 122 is stopped, and FIG. 3(*b*) shows a case where the drum 122 is decelerated and then operated at a third speed V3.

Figure 7:
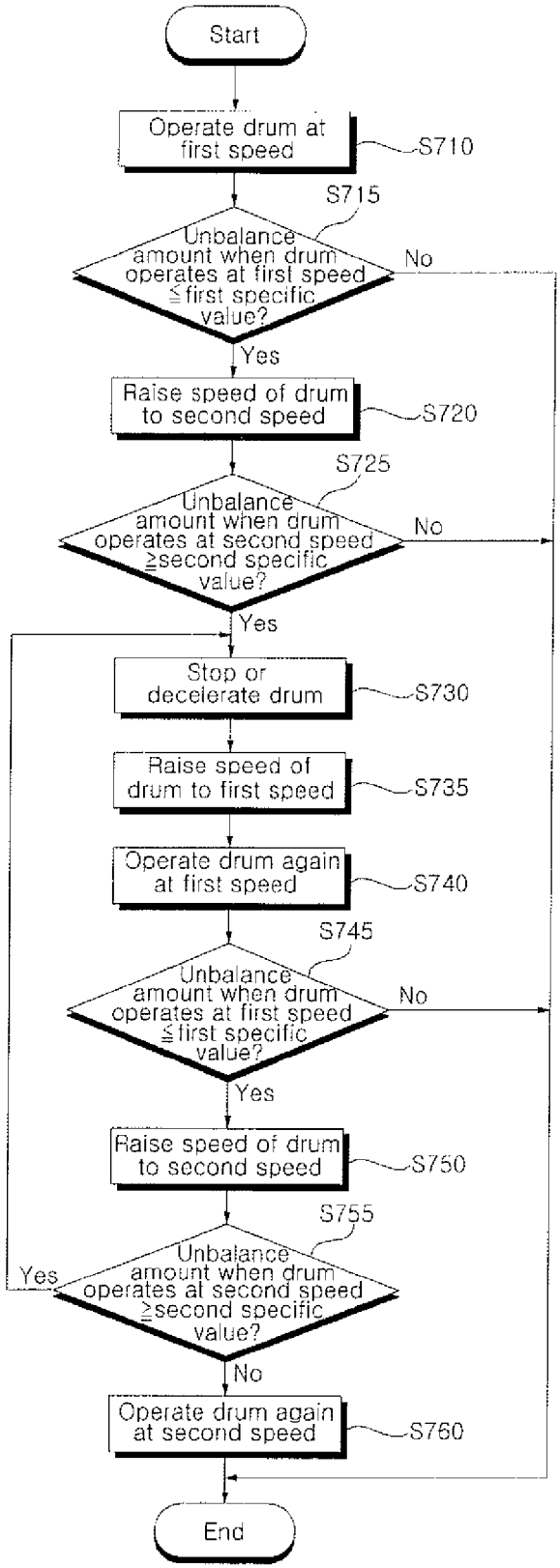
FIG. 7 is a flowchart illustrating a method of controlling the washing machine in accordance with an embodiment of the present invention.

FIG. 7 is a flowchart illustrating a method of controlling the washing machine in accordance with an embodiment of the present invention.

Description is given below with reference to the drawings. The method of controlling the washing machine shown in FIG. 7 is almost similar to that of FIG. 6. In other words, the first speed operation step to the stop or deceleration step S710 to step S730 of FIG. 7 are identical to those of FIG. 6, and the redundant description is omitted for simplicity.

After the stop or deceleration step S730, the controller 210 raises the rotation speed of the drum 122 to the first speed V1 in step S735. Here, the first speed (V1) rising slope can be changed so as to improve laundry balancing.

Next, the controller 210 operates the drum 122 again at the first speed V1 in step S740.

The controller 210 determines whether an unbalance amount during the first speed (V1) operation is a first specific value or less in step S745. In other words, the controller 210 determines whether an unbalance amount sensed by the unbalance amount sensing unit 220 is a first specific value or less in step S745.

If, as a result of the determination, the unbalance amount during the first speed (V1) operation is the first specific value or less, the controller 210 raises the rotation speed of the drum 122 to the second speed V2 in step S750. Here, the second speed (V2) rising slope can be changed so as to improve laundry balancing.

The controller 210 then determines whether an unbalance amount, which is sensed when the rotation speed of the drum 122 rises to the second speed V2, is a second specific value or more in step S755.

If, as a result of the determination, the unbalance amount, which is sensed when the rotation speed of the drum 122 rises to the second speed V2, is the second specific value or more, the controller 210 stops or decelerates the drum 122 in step S730. If, as a result of the determination in step S755, the unbalance amount is not the second specific value or more, the controller 210 controls the drum 122 to operate at the second speed in step S760.

Meanwhile, when the drum 122 is operated again after the stop or deceleration step (S730), the drum 122 can be driven in a reverse direction. In other words, in the case in which the drum 122 is operated in a first direction during the first speed operation step (S710) to the stop or deceleration step (S730), the drum 122 can be operated in a second direction, which is opposite to the first direction, when the drum 122 is operated again after the first speed rising step (S735).

As described above, an unbalance amount of the drum 122 when the rotation speed of the drum rises to the second speed after the first speed operation is determined, and, when abnormality occurs, the rotation of the drum 122 is stopped or decelerated immediately. Accordingly, stability of the washing machine and balancing of laundry at the time of the dehydration cycle can be ensured. Further, stability of the washing machine can be ensured and laundry balancing can be improved by changing at least one of the first speed rising slope and the second speed rising slope when the drum is operated again.

Meanwhile, the drum 122 can be driven at the first speed V1 at which a part of laundry is tumbled so as to meet the balancing state of the laundry to some extent, not at a speed at which the entire laundry are tumbled as in the prior art, and the drum can be then operated at the second speed V2. Accordingly, laundry can be distributed accurately and rapidly, Meanwhile, the above first speed V1 can be about 60 rpm, the second speed V2 can be about 108 rpm, and the third speed V3 can be about 30 rpm.

The method of controlling the washing machine in accordance with the present invention can be implemented as a processor-readable code in a recording medium, which can be read by a processor equipped in a washing machine. The processor-readable recording medium can include all kinds of recording devices in which data readable by a processor is stored. For example, the processor-readable recording medium can include ROM, RAM, CD-ROM, magnetic tapes, floppy disks, optical data storages, and so on, and can also be implemented in the form of carrier waves, such as transmission over the Internet. Further, the processor-readable recording medium can be distributed into computer systems connected over a network, so codes readable by a processor can be stored and executed in a distributed manner.

In accordance with an embodiment of the present invention, an unbalance amount of the drum when the rotation speed of the drum rises to a second speed after a first speed operation may be determined. When an abnormality occurs, the drum may be stopped or decelerated immediately. Accordingly, stability of the washing machine and balancing of laundry at the time of a dehydration cycle may be ensured.

Further, stability of the washing machine and laundry balancing may be improved by changing at least one of a first speed rising slope and a second speed rising slope when the drum is operated again.

The drum may be driven at a first speed at which a part of laundry is tumbled so as to meet the balancing state of the laundry to some extent, not at a speed at which the entire laundry are tumbled as in the prior art, and the drum is then operated at a second speed. Accordingly, laundry can be distributed accurately and rapidly.

Embodiment of the present invention may provide a washing machine with improved stability and improved laundry balancing at the time of a dehydration cycle, and a method of controlling a washing machine.

An embodiment of the present invention may provide a method of controlling a washing machine including a drum in which laundry are entered and rotated, including the steps of operating the drum at a first speed such that a part of the laundry is tumbled within the drum and the other part of the laundry is adhered within the drum, when an unbalance amount of the drum, which is sensed when the drum is operated at the first speed, is a first specific value or less, raising the speed of the drum to a second speed such that the laundry are adhered within the drum, and when an unbalance amount of the drum, which is sensed when the speed of the drum rises to the second speed, is a second specific value or more, stopping or decelerating the rotation of the drum.

An embodiment of the present invention may provide a washing machine, including a drum in which laundry are entered and rotated, an unbalance amount sensing unit for sensing an unbalance amount of the drum, and a controller for controlling the drum at a first speed such that a part of the laundry is tumbled within the drum and the other part of the laundry is adhered within the drum, when an unbalance amount of the drum, which is sensed when the drum is operated at the first speed, is a first specific value or less, controlling the speed of the drum to rises a second speed such that the laundry are adhered within the drum, and, when an unbalance amount of the drum, which is sensed when the speed of the drum rises to the second speed, is a second specific value or more, controlling the rotation of the drum to stop or decelerate.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a washing machine that includes a drum, the method comprising:

rotating the drum at a first speed at which part of laundry within the drum tumbles and another part of the laundry adheres to the drum;

detecting an unbalance amount of the drum while the drum rotates at the first speed;

when the unbalance amount of the drum detected at the first speed is a first specific value or less, increasing the rotational speed of the drum from the first speed to a second speed so that substantially all of the laundry adheres to the drum;

detecting an unbalance amount of the drum while the rotational speed of the drum increases from the first speed to the second speed;

when the unbalance amount of the drum detected while the rotational speed of the drum increases from the first speed to the second speed is a second specific value or more, decelerating the rotation of the drum below the first speed;

increasing the rotational speed of the drum to the first speed after decelerating the rotation of the drum below the first speed; and again rotating the drum at the first speed, wherein a rising slope of the rotational speed of the drum while the rotational speed of the drum increases after decelerating the rotation of the drum below the first speed is different from the rising slope of the rotational speed of the drum during the preceding increase of the rotational speed of the drum to the first speed.

2. The method of claim 1, wherein the again rotating the drum at the first speed further comprises rotating the drum in a reverse direction.

3. The method of claim 1, further comprising:

increasing the rotational speed of the drum from the first speed to the second speed after rotating the drum at the first speed following the decelerating of the drum below the first speed.

4. The method of claim 3, wherein a rising slope of the rotational speed of the drum while the rotational speed of the drum increases from the first speed to the second speed, after rotating the drum at the first speed which follows the decelerating of the rotation of the drum below the first speed, is different from a rising slope of the rotational speed of the drum during the preceding increase of the rotational speed of the drum from the first speed to the second speed.

5. The method of claim 1, wherein the first speed is approximately 60 rpm.

6. The washing machine of claim 1, wherein the controller further controls the rotational speed of the drum to be increased from the first speed to the second speed after rotating the drum at the first speed following the deceleration of the rotation of the drum.

7. The washing machine of claim 6, wherein the controller controls a rising slope of the rotational speed of the drum while the rotational speed of the drum increases from the first speed to the second speed, after rotating the drum at the first speed which follows the deceleration of the rotation of the drum, to be different from a rising slope of the rotational speed of the drum during the preceding increase of the rotational speed of the drum from the first speed to the second speed.

8. The washing machine of claim 1, wherein the part of the laundry that tumbles is located closer to a center of the drum than the part of the laundry that adheres to the drum.

9. The washing machine of claim 8, wherein a center of mass of each article of the laundry that tumbles is located closer to a center of the drum than a center of mass of each article of the laundry that adheres to the drum.

10. The washing machine of claim 1, wherein during the rotation of the drum at the first speed part of the laundry within the drum tumbles and another part of the laundry adheres to the drum at each rotational angle of the drum through a full revolution of the drum.

11. A washing machine, comprising:

a drum that rotates laundry;

an unbalance amount sensor that senses an unbalance amount of the drum; and a controller that:

controls a rotational speed of the drum to rotate at a first speed , at which part of the laundry within the drum tumbles and another part of the laundry adheres to the drum;

when an unbalance amount of the drum sensed while the drum rotates at the first speed is a first specific value or less controls the rotational speed of the drum to be increased from the first speed to a second speed so that substantially all of the laundry adheres to the drum; and when an unbalance amount of the drum sensed while the rotational speed of the drum increases from the first speed to the second speed is a second specific value or more, controls the rotation of the drum to be decelerated to a speed below the first speed;

controls the rotational speed of the drum to be increased to the first speed after the deceleration of the rotation of the drum to the speed below the first speed, and to be maintained at the first speed, wherein the controller controls a rising slope of the rotational speed of the drum while the rotational speed of the drum increases after the decelaration of the rotation of the drum to the speed below the first speed to be different from a rising slope of the rotational speed of the drum during the preceding increase of the rotational speed of the drum to the first speed.

12. The washing machine of claim 11, wherein during the rotation of the drum at the first speed part of the laundry within the drum tumbles and another part of the laundry adheres to the drum at each rotational angle of the drum through a full revolution of the drum.

13. The washing machine of claim 11, wherein the controller further controls the drum to rotate in a reverse direction after the deceleration of the rotation of the drum.

14. The washing machine of claim 11, wherein the first speed is approximately 60 rpm.

15. The washing machine of claim 11, wherein the part of the laundry that tumbles is located closer to a center of the drum than the part of the laundry that adheres to the drum.

16. The washing machine of claim 15, wherein a center of mass of each article of the laundry that tumbles is located closer to a center of the drum than a center of mass of each article of the laundry that adheres to the drum.

* * * * *